US005524062A

United States Patent [19]

Oh

[11] Patent Number: 5,524,062

[45] Date of Patent: Jun. 4, 1996

[54] SPEAKER SYSTEM FOR A TELEVISON SET

[75] Inventor: Kyoung-Chul Oh, Incheon, Rep. of Korea

[73] Assignee: Daewoo Electronics Co., Ltd., Seoul, Rep. of Korea

[21] Appl. No.: 279,771

[22] Filed: Jul. 25, 1994

[30] Foreign Application Priority Data

Jul. 26, 1993 [KR] Rep. of Korea ..... 93 14163

[51] Int. Cl.[6] ..... H04R 25/00

[52] U.S. Cl. ..... 381/154; 381/24; 381/159; 181/156

[58] Field of Search ..... 381/154, 159, 381/153, 156, 24, 152, 88, 90, 188, 205; 181/152, 148, 155, 199, 156, 182, 184, 187

[56] References Cited

U.S. PATENT DOCUMENTS 1,969,704 8/1934 D'Alton ..... 181/31

4,524,846 6/1985 Whitby ..... 181/152

4,930,596 6/1990 Saiki et al. ..... 181/152

*Primary Examiner*—Curtis Kuntz

*Assistant Examiner*—G. J. Oehling

*Attorney, Agent, or Firm*—Anderson Kill Olick & Oshinsky

[57] ABSTRACT

A speaker system comprises a speaker for reproducing a sound, a main acoustic radiation housing for transferring the reproduced sound forwardly radiated from the speaker toward a listening location, and an auxiliary acoustic radiation duct attached to a rear portion of the radiation housing for collecting the reproduced sound backwardly emanating from the speaker and transferring it toward the listening location. The radiation housing includes a plurality of axially parallel partitions formed therein for providing acoustic waveguides corresponding to the number of notes of an octave. The waveguides are provided with acoustic separating holes formed at a side wall of the radiation housing, which are serially arranged in conformity with the notes of the octave.

8 Claims, 5 Drawing Sheets

SPEAKER SYSTEM FOR A TELEVISON SET

FIELD OF THE INVENTION

The present invention relates to a speaker system; and, more particularly, to a speaker system for use in a television set, which comprises a plurality of acoustic waveguides formed in an acoustic radiation housing of the speaker system for corresponding to the number of notes of an octave, and acoustic separating holes provided at the respective acoustic waveguides and serially arranged in conformity with the notes of the octave, capable of separating individual timbres corresponding to the notes of the octave from a sound reproduced by a speaker via the holes during the passing of the reproduced sound through the waveguides.

DESCRIPTION OF THE PRIOR ART

Various speaker systems for a television set have been proposed to convert electrical signals into sounds which consist of different frequencies. In recent years, in order to produce a complex sound, it has been a general trend in the art to equip the television set with a tweeter and a woofer, each of which is designed to reproduce the high or low frequency sound. However, in the known speaker systems, there is no provided with a sound radiating device for separating timbres from the sound reproduced by the speaker. Herein, the word "timbre" is used to denote the "tone quality" or "tone color" of a sound. A typical speaker system for use in the television set is shown in FIG. 6 wherein a speaker 10 is mounted in a sound radiating box 12. As shown in FIG. 6, the radiating box 12 is constructed of a generally rectangular parallelepiped shape, a front portion of which has a smaller cross-sectional area than that of a rear portion thereof in which the speaker 10 is located. The front portion of the box 12 is provided with a single sound discharging port 14 which serves to propagate the reproduced sound toward a listening location therethrough. Although such a speaker system has been useful for its intended purpose, there exists a disadvantage in that it cannot separate independent timbres from the reproduced sound, which may not produce a good quality of the reproduced sound.

SUMMARY OF THE INVENTION

Accordingly, it is an object of the present invention to provide a speaker system for a television set which is capable of separating individually tone colors corresponding to notes of a scale from a sound reproduced by a speaker to thereby enhance a good quality of the sound.

It is another object of the present invention to provide a speaker system with an auxiliary acoustic radiation duct which can collect a reproduced sound backwardly, emanating from a speaker and radiate it toward a listening location, expanding a low range of the sound.

The above and other objects of the present invention are accomplished by providing a speaker system for a television set, including a speaker for reproducing a sound, which comprises:

a main acoustic radiation housing for transferring the reproduced sound forwardly radiated from the speaker toward a listening location and constructed of a generally rectangular parallelepiped configuration;

a plurality of axially parallel partitions formed in said radiation housing for providing acoustic waveguides corresponding to the number of notes of an octave;

said waveguides including acoustic separating holes formed at a side wall of said radiation housing and serially arranged in conformity with the notes of the octave; and an auxiliary acoustic radiation duct attached to a rear portion of said radiation housing for collecting the reproduced sound backwardly emanating from the speaker and transferring it toward the listening location.

In accordance with a preferred embodiment of the present invention, each of the partitions is oriented at its rear portion to converge toward a central point of the speaker so that the reproduced sound can enter into the waveguides with divergence. Further, the rear ends of the partitions are spaced at a substantially equal distance from the central point of the speaker. The number of the acoustic separating holes is eight and the acoustic separating holes are steppedly disposed to match the order of the eight notes of the octave. Additionally, a distance between the third and fourth holes and between the seventh and the eighth holes is half of that between the remaining contiguous holes about their vertical lines.

BRIEF DESCRIPTION OF THE DRAWINGS

The above and other objects, features and advantages of the present invention will become apparent from the following description given in conjunction with the accompanying drawings, in which.

DETAILED DESCRIPTION OF THE PREFERRED EMBODIMENTS

Figure 1:
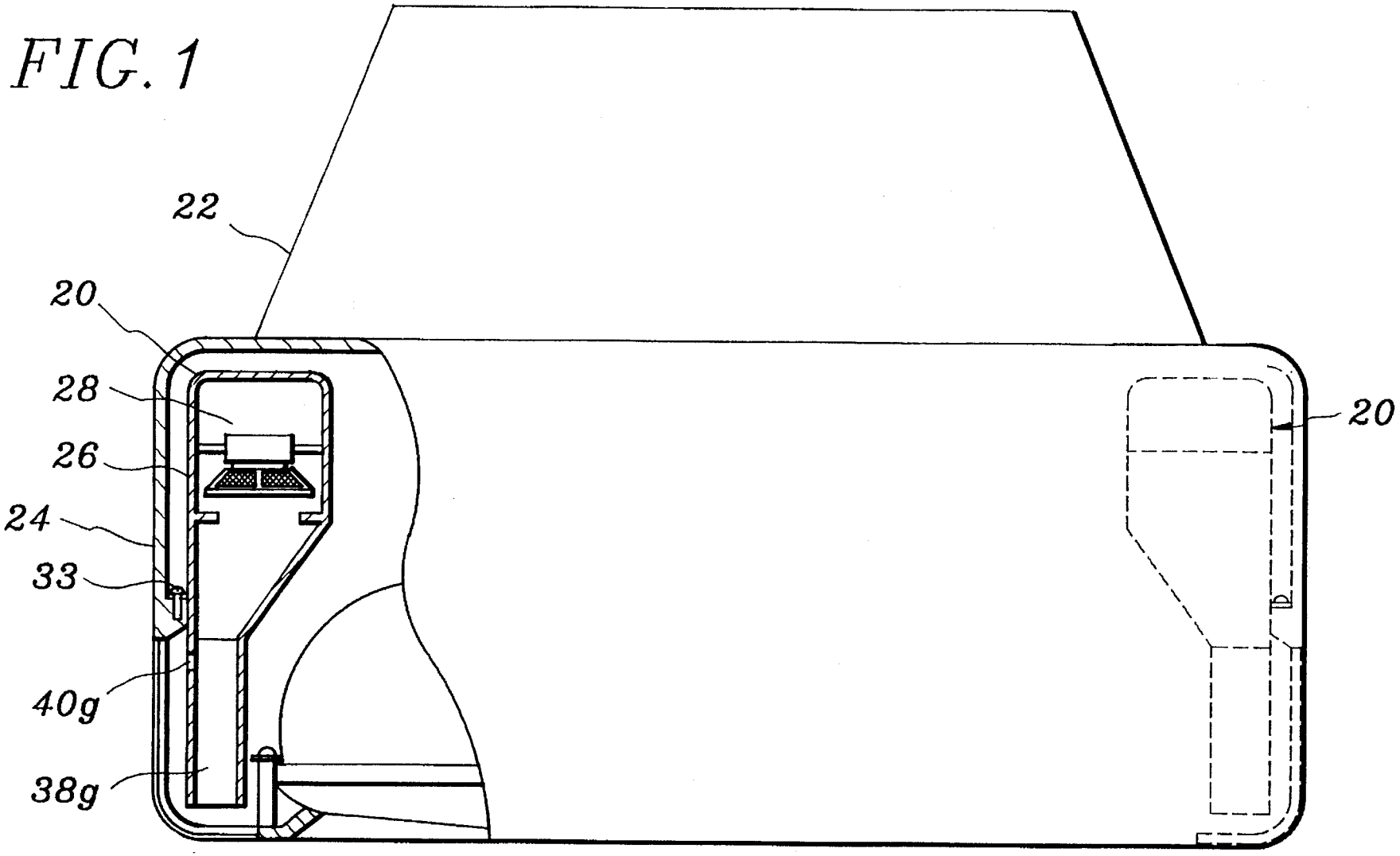
FIG. 1 is a partially sectional view of a speaker system incorporated in a television set in accordance with a preferred embodiment of the present invention.
Figure 2:
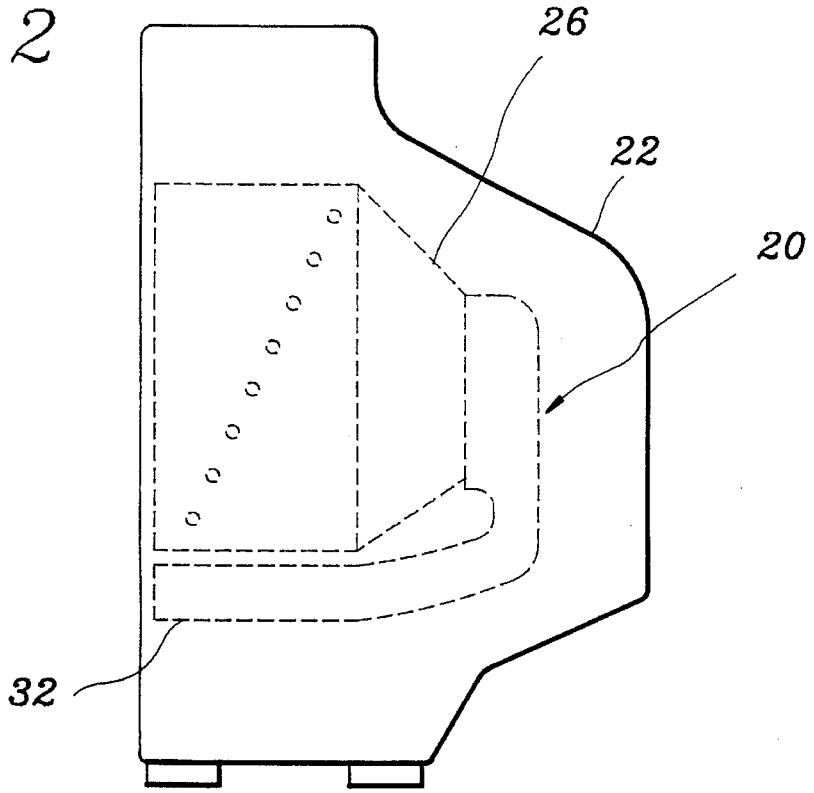
FIG. 2 is a side elevational view of the television set shown in FIG. 1, with the speaker system being illustrated by a dotted line.

Referring now to FIGS. 1 and 2, there is schematically shown a speaker system. 20 incorporated in a television set 22 in accordance with a preferred embodiment of the present invention. Generally, the speaker systems 20 are mounted in opposite sides of a cabinet 24 of the television set 22 so as to provide a proper propagation of a reproduced sound therefrom to a great extent.

Figure 3:
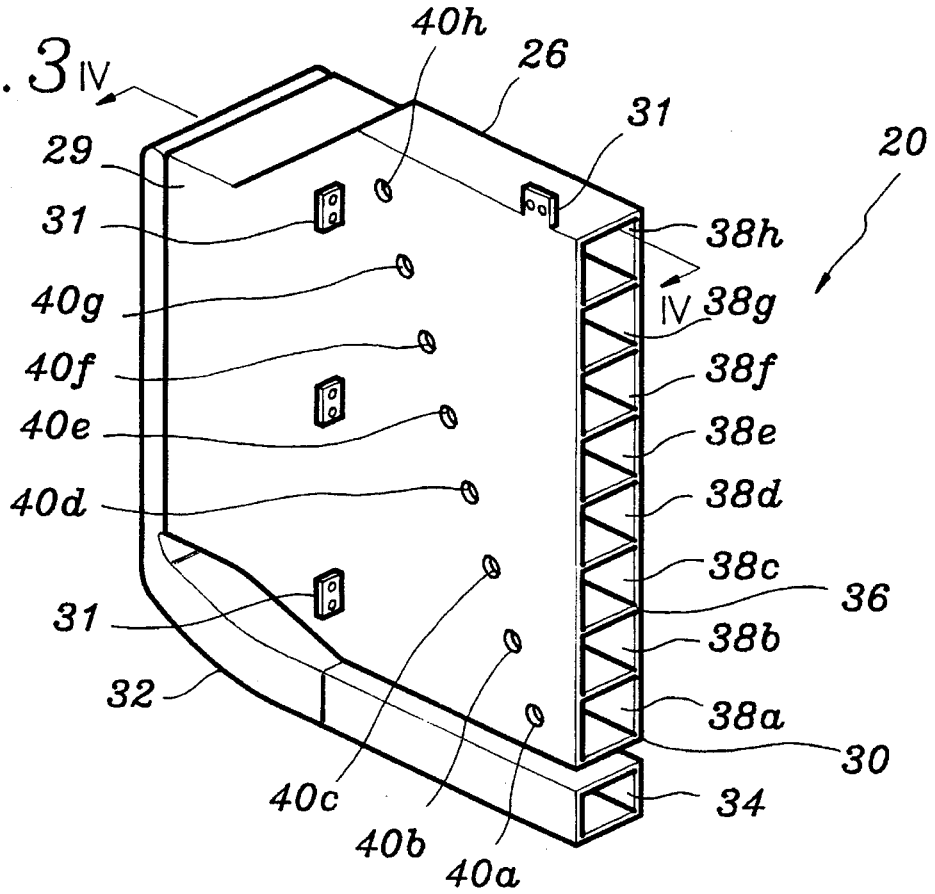
FIG. 3 is a perspective view of the speaker system in accordance with the present invention.
Figure 4:
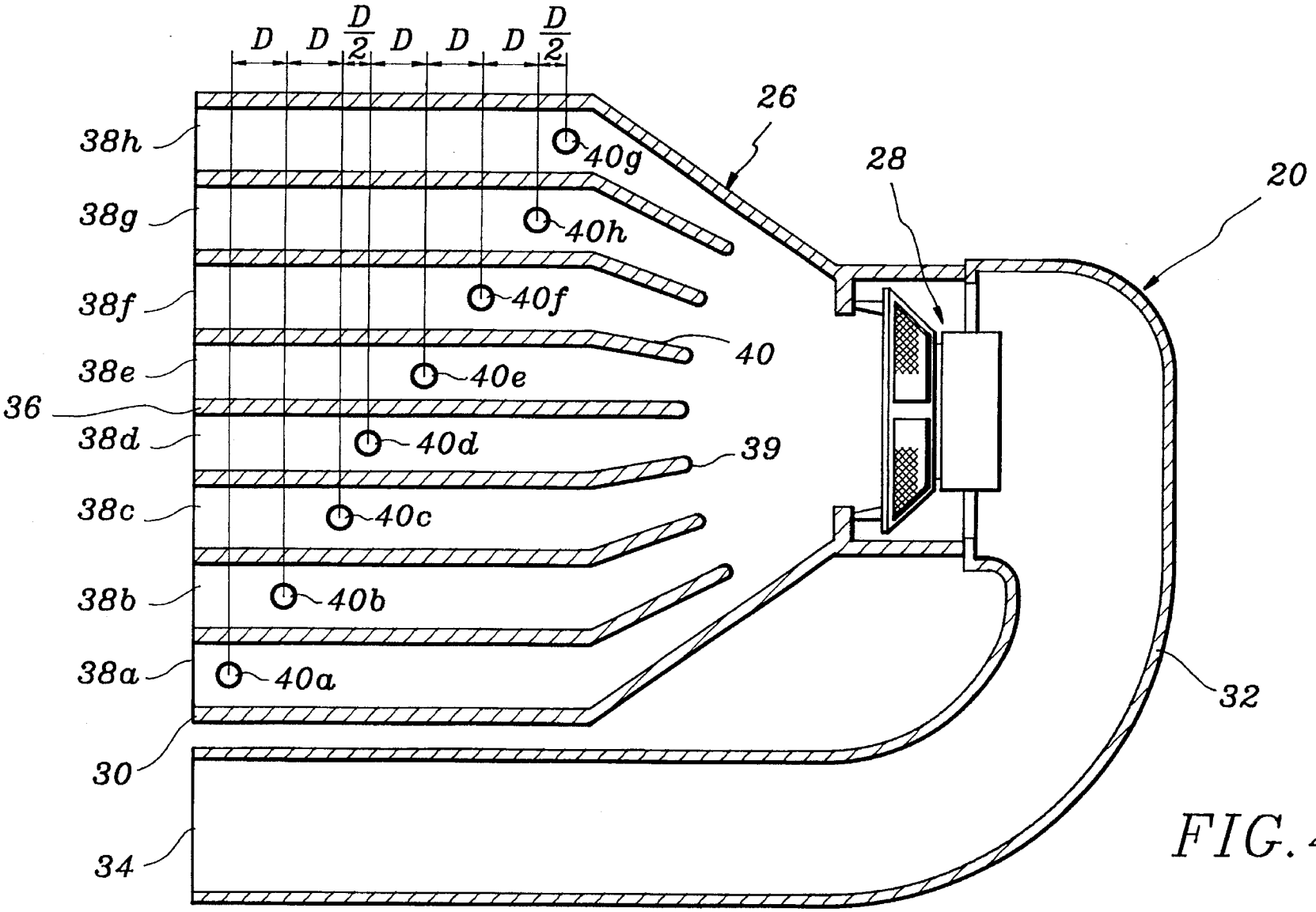
FIG. 4 is a cross; sectional view taken along line IV—IV of FIG. 3.

As shown in FIG. 3, the speaker system 20 comprises a main acoustic radiation housing 26 and a speaker 28 mounted in a rear portion of the radiation housing 26 for reproducing a sound(see FIG. 4). The radiation housing 26 is constructed of a generally flared rectangular parallelepiped configuration, the rear portion of which has a greater cross-sectional area than that of a front portion thereof so as to properly accommodate the speaker 28 therein. The radiation housing 26 has a radiating exit 30 provided at the front portion thereof which is open to an ambient air. Further, the radiation housing 26 includes mounting brackets 31 provided at its side wall 29, which are rigidly engaged with the cabinet 24 of the television set 22 by a fixture, e.g., screws 33 (see FIG. 1). Particularly, the radiation housing 26 serves to transfer the reproduced sound forwardly radiated from the speaker 28 toward a listening location. In addition, attached to the rear portion of the radiation housing 26 is an auxiliary acoustic radiation duct 32 which can collect the reproduced sound(e.g., generally a low range of the sound) backwardly emanating from the speaker 28 and then radiate it toward the listening location. As shown in FIGS. 3 and 4, the radiation duct 32 is extended forward from the rear portion of the radiation housing 26; and disposed substantially beneath and in parallel to the radiation housing 26. A radiating exit 34 of the duct 32 is arranged in a substantially coplanar relationship with the exit 30 of the radiation housing 26 about their vertical line, thereby enabling the reproduced sound radiated from both the housing 26 and the duct 32 to reach simultaneously the listening position. In particular, the additional provision of the radiation duct 32 with the speaker system 20 renders it possible to expand the low range of the sound, thereby enhancing the sound effect.

As best shown in FIG. 4, formed in the acoustic radiation housing 26 is a plurality of partitions 36 arranged in an axially parallel relationship with each other, which define acoustic waveguides **38*a*–38*h* corresponding to the number of notes of an octave. As used herein, the notes of the scale are intended to mean Do, Re, Mi, Fa, Sol, La, Si, Do as denoted in a musical field, respectively, each of which has generally a fundamental frequency. On the other hand, rear end portions 40 of the respective partitions 36 are oriented to converge toward a central point (not shown) of the speaker 28 so that the reproduced sound can enter into the respective waveguides 38*a*–38*h* with divergence. Further, the rear ends 39 of the partitions 36 are spaced at a substantially equal distance from the central point of the speaker 28 to thereby form an arc configuration about the central point of the speaker 28. Each of the ends 39 of the partitions 36 is made of a rounded shape so that the reproduced sound is smoothly introduced into the waveguides 38*a*–38*h*. In addition, each of the waveguides 38*a*–38*h*** has a substantially equal cross-sectional area.

As depicted in FIGS. 3 and 4, the respective waveguides **38*a*–38*h* are provided with acoustic separating holes 40*a*–40*h* formed at the side wall 29 of the radiation housing 26 in order to partly discharge the reproduced sound to the ambient air therethrough. The holes 40*a*–40*h* are serially arranged in a predetermined diagonal direction so as to separate individually timbres corresponding to (the fundamental frequencies of) the eight notes(i.e., "Do", "Re", "Mi" - - - "Do") of the octave from the reproduced sound. That is, the lowermost hole 40*a* is defined as the first note "Do" of the octave and positioned far away from the speaker 28, while the uppermost hole 40*h* as the eighth note "Do" is disposed near the speaker 28. In a similar way, the remaining holes 40*b*–40*g*** are located in a stepwise relationship with each other to define the second to the seventh notes, respectively.

Further, as best shown in FIG. 4, the distance between the third hole **40*c* and the fourth hole 40*d* and between the seventh hole 40*g* and the eighth hole 40*h*** is half of that between the remaining contiguous holes about their vertical lines. Therefore, this results in the formation of a semitone between the third note("Mi") and the fourth note("Fa") and between the seventh note("Si") and the eighth note("Do") as represented by a musical instrument, respectively.

Figure 5A:
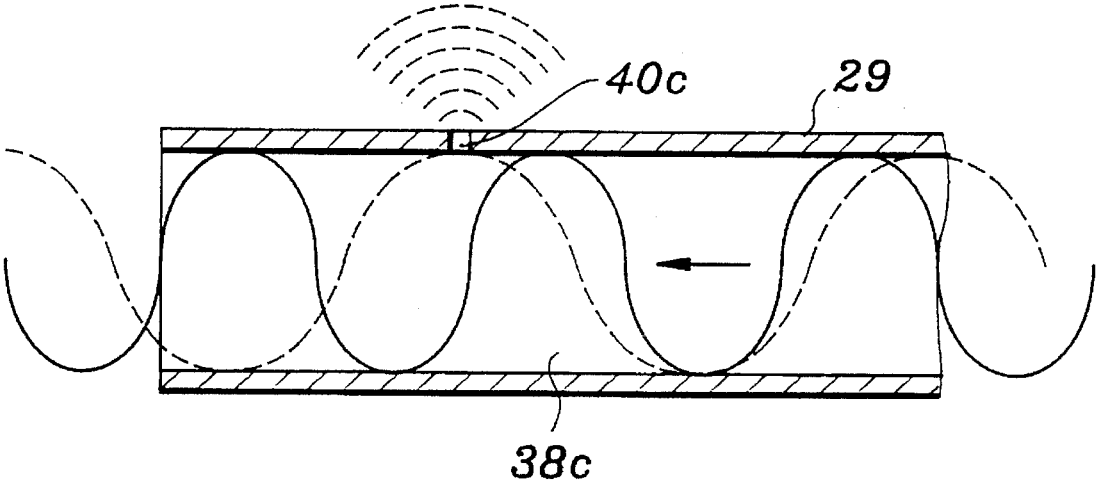
FIGS. 5(A) and 5(B) show the acoustic separating procedure during the progressing of a sound reproduced from a speaker through acoustic waveguides of the speaker system of the present invention.
Figure 5B:
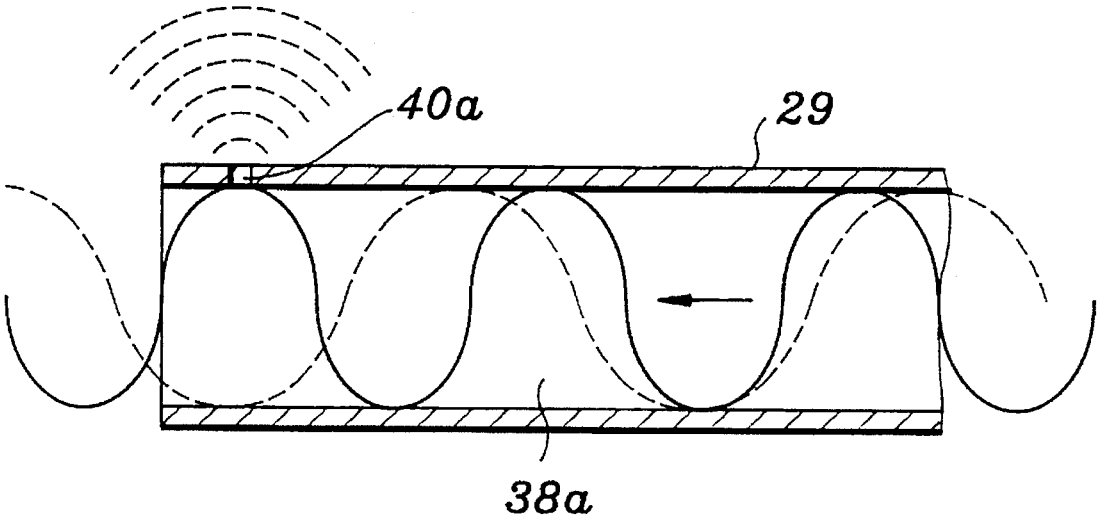
Figure 6:
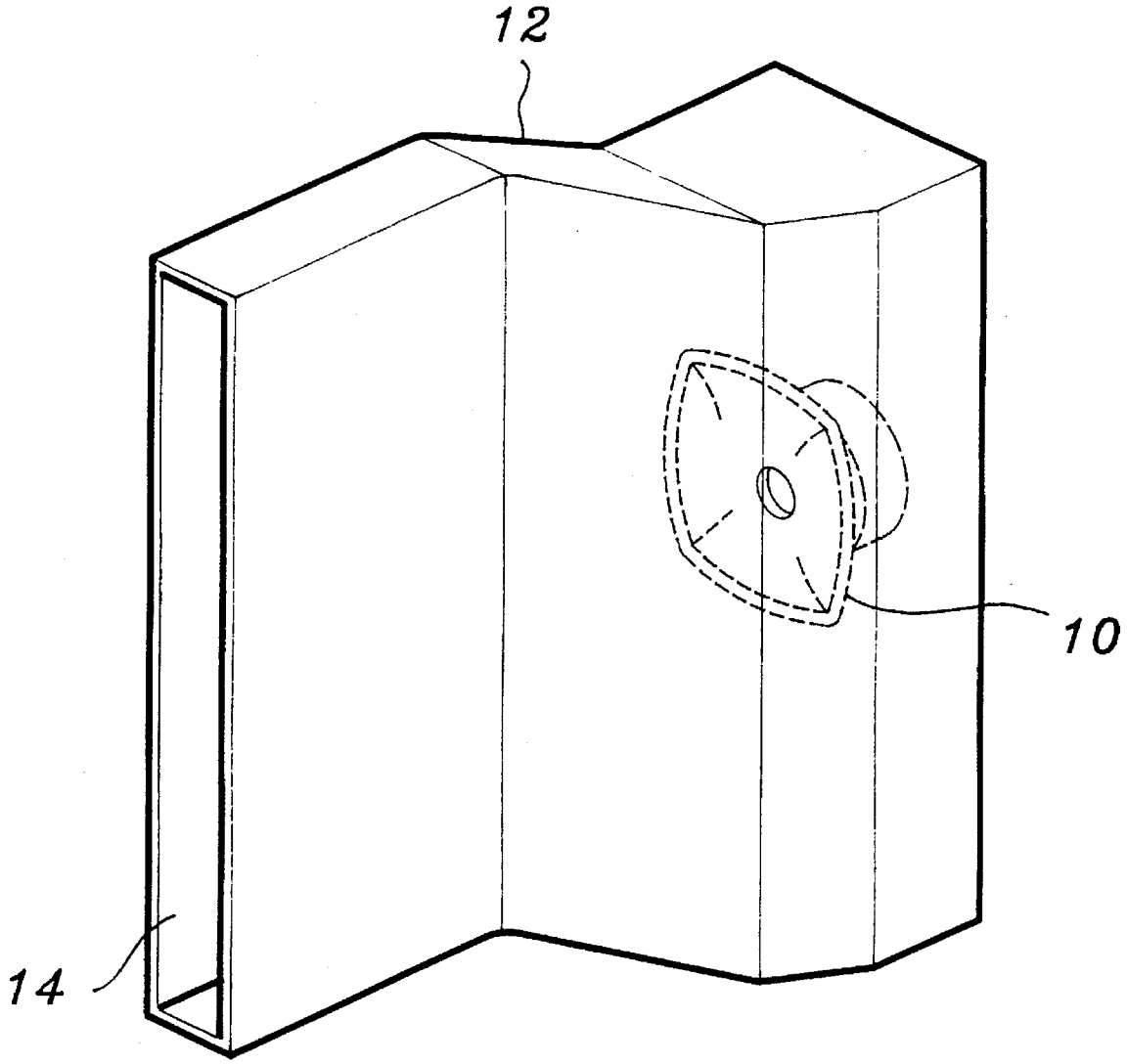
FIG. 6 (PRIOR ART)
FIG. 6 depicts a perspective view of a typical speaker system for a television set.

As discussed above, in accordance with a preferred speaker system of the present invention, the sound reproduced from the speaker 28 enters into divergently the respective waveguides **38*a*–38*h* of the radiation housing 26 and then propagates to the listening location through the exit 30 of the housing. At this time, as shown in FIGS. 5(A) and 5(B), for example, if a wavelength of the sound passing through the given waveguide matches with the predetermined hole (corresponding to the note of the octave), that sound can be partially discharged from the waveguide to the ambient air via the hole. As a result, this enables the timbres corresponding to (the fundamental frequencies of) the respective notes to be independently separated from the reproduced sound with accuracy, further enhancing the quality of the sound. On the other hand, the reproduced sound backwardly emanating from the speaker 28 collects in the duct 32 and then radiates toward the listening location through the exit 34 of the duct 32**. Therefore, this results in the expansion effect of the low range sound.

Although the invention has been shown and described with respect to the preferred embodiments, it will be understood by those skilled in the art that certain changes and modifications may be made without departing from the spirit and scope of the invention as defined in the following claims.

What is claimed is:

1. A speaker system for a television set, including a speaker for reproducing a sound, which comprises:

a main acoustic radiation housing for transferring the reproduced sound forwardly radiated from the speaker toward a listening location and constructed of a generally rectangular parallelepiped configuration;

a plurality of axially parallel partitions formed in said radiation housing for providing acoustic waveguides corresponding to eight notes of an octave;

said waveguides including eight acoustic separating holes formed at a side wall of said radiation housing and arranged stepwise in a predetermined diagonal direction to match the order of the eight notes of the octave; and an auxiliary acoustic radiation duct attached to a rear portion of said radiation housing for collecting the reproduced sound backwardly emanating from the speaker and transferring it toward the listening location.

2. The speaker system of claim 1, wherein said partitions are oriented at their rear portions to converge toward a central point of the speaker.

3. The speaker system of claim 2, wherein the rear ends of said partitions are spaced at a substantially equal distance from the central point of the speaker.

4. The speaker system of claim 3, wherein each of said waveguides has a substantially equal cross-sectional area.

5. The speaker system of claim 3, wherein the rear ends of said partitions are made of a rounded shape.

6. The speaker system of claim 1, wherein said housing and said duct have radiating exits arranged in a coplanar vertical plane.

7. The speaker system of claim 1, wherein said radiation duct is extended forward from the rear portion of said radiation housing and disposed substantially beneath and parallel to said radiation housing.

8. The speaker system of claim 1, wherein a distance between the third and fourth holes and between the seventh and the eighth holes is half of that between the remaining contiguous holes about their vertical lines.

* * * * *